United States Patent [19]

Stein

[11] Patent Number: 4,791,944

[45] Date of Patent: Dec. 20, 1988

[54] EYELASH CURLER

[76] Inventor: Robert F. Stein, 271 Paradise Cove, Malibu, Calif. 90265

[21] Appl. No.: 65,415

[22] Filed: Jun. 22, 1987

Related U.S. Application Data

[63] Continuation-in-part of Ser. No. 837,530, Mar. 7, 1986.

[51] Int. Cl.[4] ..... A45D 2/42

[52] U.S. Cl. ..... 132/217

[58] Field of Search ..... 132/32 C, 31 A

[56] References Cited

U.S. PATENT DOCUMENTS

| | | | |
|---|---|---|---|
| 1,665,327 | 4/1928 | Rissinger | 132/32 C |
| 1,951,130 | 3/1934 | Cohn et al. | 132/32 C |
| 2,314,375 | 3/1943 | Tuttle et al. | 132/32 C |
| 2,393,848 | 1/1946 | Wasserman | 132/32 C |
| 2,411,519 | 11/1946 | Byron | 132/32 C |
| 2,552,095 | 5/1951 | Hickey | 132/32 C |
| 2,565,541 | 8/1951 | Wolff | 132/32 C |
| 2,584,668 | 2/1952 | Brown | 132/32 C |
| 3,838,699 | 10/1974 | Skandalakis | 132/31 A |

FOREIGN PATENT DOCUMENTS

| | | | |
|---|---|---|---|
| 907936 | 3/1946 | France | 132/32 C |
| 918435 | 2/1947 | France | 132/32 C |
| 945545 | 5/1949 | France | 132/32 C |
| 947341 | 6/1949 | France | 132/32 C |
| 1072388 | 11/1951 | France | 132/32 C |

*Primary Examiner*—Gene Mancene
*Assistant Examiner*—Cary E. Stone
*Attorney, Agent, or Firm*—Timothy T. Tyson

[57] ABSTRACT

An eyelash curler and method for curling eyelashes. The curler has an upper jaw for placement on top of the eyelashes and a lower jaw for placement under the eyelashes. The angle of the upper jaw to the handle is approximately 48° allowing the curler to be positioned in contact with the cheek during use. The person holds the curler with two fingers on two finger grips on opposite sides of a sleeve and a thumb on the thumb grip at the bottom of a plunger. The curler is sighted in a mirror through an alignment aperture in the neck and the curler is moved toward the eyelashes while keeping the reflection of the pupil in the aperture until the first finger grip touches the upper cheek and the thumb grip touches the lower cheek. Once contact is made, the hand is maneuvered slightly about the finger grip until the upper jaw contacts the eyelid. The thumb grip is then squeezed toward the finger grips until the lower jaw butts against the upper jaw curling the eyelashes between them.

12 Claims, 4 Drawing Sheets

EYELASH CURLER

RELATED APPLICATION

This application is a continuation-in-part of applicant's previously filed application Ser. No. 837,530, filed Mar. 7, 1986 pending.

TECHNICAL FIELD

The present invention pertains to the toiletry art with respect to hair devices, and more particularly, to an eyelash curler.

BACKGROUND ART

Numerous devices have been developed for curling or crimping eyelashes. The most popular eyelash curler currently available is illustrated in FIGS. 1 to 3. As shown in FIG. 2, the eyelash curler 10 is formed of wire into the shape of a scissors or pliers with a stationary member 12 and a moving member 14 that rotates about the stationary member 12 on an axle 16. Each member 12 and 14 has a finger grip 18 and 20, respectively, through which the thumb and the index finger of one hand are slipped to operate the curler 10. The curler 10 is positioned in front of the face 22 with the eyelashes 24 from the eyelid 25 of one eye 28 passing between the stationary jaw 30 and the moving jaw 32. The stationary jaw 30 is positioned either on or slightly away from the eyelid 25 and ideally does not move during the crimping operation. The eyelashes 24 are crimped when the finger grip 20 is moved toward the finger grip 18 forcing the moving member 14 to rotate on the axle 16 pushing a connector member 34 upward thereby pushing the moving jaw 32 upward against the stationary jaw 30. As shown in the enlarged sectional and partially cut away view of FIG. 3, the eyelashes 24 are trapped between the jaws 30 and 32 when the finger grips 18 and 20 are squeezed together. The stationary jaw 30 is a metal blade rectangular in cross section. The moving jaw 32 has a resilient firm rubber pad 36 also rectangular in cross section when not under compression. The stationary jaw 30 is welded to the stationary member 12. The moving jaw 32 includes a rigid metal carrier 38 welded to the connector member 34 and collars 40 and 42 on each end as shown in FIG. 1. The collars 40 and 42 retain the moving jaw 32 on the stationary member 12 allowing the moving jaw 32 to move up or down along the stationary member 12 as the finger grips 18 and 20 are pinched together or released. As the rectangular blade of the moving jaw 32 is pressed into the rubber pad 36, the rubber pad 36 compresses forming a square cornered "U". The eyelashes 24 are crimped at the two bottom corners of the "U" around the two bottom edges 44 and 46 of the stationary jaw 30. Crimping bends the eyelash shafts at sharp angles. When the eyelash curler 10 is removed, the eyelashes 24 retain the two bends or crimps giving the eyelashes an upward curved appearance.

Several problems are created by the design of the eyelash curler 10. Pinching of the eyelid 26 or other skin around the eye 28 often occurs between the stationary jaw 30 and the rubber pad 36 when the curler 10 is squeezed. The stationary jaw 30 is initially positioned with respect to the eyelid 26 by placing the inner side 48 of the stationary jaw 30 against the eyelid 26. The stationary jaw 30 is then moved slightly away from the eyelid 26. Alternatively, the stationary jaw 30 is positioned visually on the eyelashes 24. In either case, the eyelashes 24 are crimped as close as possible to the eyelid 26 in order to achieve the maximum lift on the outer ends 50. If the jaws 30 and 32 are too far away from the eyelid 26, little visible curling occurs. If the jaws 30 and 32 are too close, the rubber pad 36 may press the eyelid 26 against the stationary jaw 30 causing a painful pinch. The curler 10 may also pinch by catching a small portion of the eyelid at the inner or outer corners between the collar 42 and the stationary member 12 as indicated by the arrow 52 in FIG. 3 causing a pinch when the collar 42 moves up.

Maintenance of any set position of the stationary jaw 30 during the squeezing process is always a problem due to the scissors action of the curler 10 and the distance of the finger grips 18 and 20 from the jaws 30 and 32. The stationary jaw 30 is preferably kept at a single position slightly off the eyelid 26 during the crimping process. The position of the stationary jaw 30 is determined primarily by the position of the stationary finger grip 18 and secondarily by the moving finger grip 20 through the axle 16. During the scissors action, the natural tendancy of the hand is to move the finger grips 18 and 20 toward each other. The result is movement of the stationary jaw 30 away from the desired position. This problem is compounded by the distance between the finger grip 18 and the stationary jaw 30. Any movement of the finger grip 18 is magnified at the stationary jaw 30. Thus, for example, a small unintended rotation of the statinary finger grip 18 on the order of 5° during the squeezing process will easily move the stationary jaw 30 far from the eyelid 25 resulting in an unsatisfactory crimp of the eyelashes 24. On the other hand, over compensation for this operating characteristic of the curler 10 in the opposite direction can easily place the stationary jaw 30 against the eyelid 26 which may lead to a painful pinch.

The shapes of the jaws 30 and 32 and the scissors action may also cause pulling, over-curling, and cutting of the eyelashes 24. As illustrated in FIG. 3, during the crimping process the eyelashes 24 are trapped between the bottom of the rectangular stationary jaw 30 and the rubber pad 36. Most of the pressure between the two jaws 30 and 32 is focused between the bottom edges 44 and 46 and the rubber pad 36. The eyelashes 24 are therefore primarily held at these positions. Any movement of the stationary jaw 30 away from the eyelid 26 during the crimping process can easily result in the pulling of one or more eyelashes 24 from the eyelid 26. Excessive pressure between the jaws 30 and 32 may result in the over-curling or cutting of the eyelashes 24. Because both the bottom of the stationary jaw 30 and the top of the rubber pad 36 are flat, significant pressure is required to depress the top of the hard rubber pad 36 into the shape required to properly crimp the eyelashes 24. Inadequate pressure results in no crimping of the eyelashes 24. Excessive pressure results in the bottom edges 44 and 46 digging into the eyelashes 24 causing damage by excessive bending or cutting of the eyelashes. The cutting is caused by the sliding action between the bottom edges 44 and 46 and the squared sides of the depressed rubber pad 36 as the edges are pushed into the pad. The ideal pressure range to achieve a desired result is relatively narrow often causing the user to repeat the crimping process several times before a desire result is achieved. U.S. Pat. Nos. 2,252,742 and 2,391,047 show scissors type eyelash curlers similar to the eyelash curler 10 illustrated in FIGS. 1–3.

Plunger type eyelash curlers which avoid the scissors action are disclosed in U.S. Pat. Nos. 1,951,130; 2,129,755; 2,393,848; 2,411,519; 2,552,095; 2,584,668; and 2,684,679 and in French Pat. Nos. 907,936 and 945,545. Of these, U.S. Pat. Nos. 1,951,130 and 2,129,755 and French Pat. No. 945,545 have a wiper action where a lower member wipes the eyelashes up against the outside of a rigid upper member as the lower member is pushed up. The remainder have rigid lower and upper jaws which abut when pushed together.

Most of the above plunger type eyelash curlers require the use of two hands for positioning and operation. Furthermore, the devices in U.S. Pat. Nos. 2,129,755; 2,393,848; 2,584,668; and 2,984,679 and French Pat. No. 945,545 appear to be designed for use only by a person to perform the curling treatment on someone else. The lack of a jaw pad in U.S. Pat. No. 2,411,519 and the hard pads in U.S. Pat. No. 2,552,095 and French Pat. No. 907,936 suggest that two handed operation is required in order to achieve sufficient pressure between the jaws to curl the eyelashes. Also, in U.S. Pat. Nos. 2,411,519 and 2,552,095, the close relative positions of the thumb and finger grips at the bottoms of the devices decrease stability and do not allow the utilization of the maximum strength of the hand which occurs when the fingers are partially open. An eyelash curler that has a movement parallel to the face, is stable at all positions during movement, is easily used by one hand, and has a pad and head with a jaw structure optimizing the curling of the eyelashes while minimizing the hand force necessary would provide significant advantages over the prior art devices.

DISCLOSURE OF INVENTION

The present invention is directed to an curler for eyelashes having an upper jaw that is positioned on top of the eyelashes to be curled and a lower jaw that is positioned below the eyelashes. The upper jaw has a curling bar member and the lower jaw has a resilient convex pad member. The eyelashes are curled when the curling bar member and the resilient convex pad member are pressed together. The convex shape of the pad member minimizes the pressure required to achieve a desired curl of the eyelashes thereby also minimizing the possibility of overcurling, cutting, or pulling out the eyelashes.

In accordance with one important aspect of the invention, the pad member has a soft resilient center and a cleanable surface means. The center requires a relatively porous material in order to be soft. If unprotected, the pores tend to collect foreign objects. The cleanable surface means covers the porous center material with a non-porous material that is readily cleanable.

In accordance wtih another important aspect of the invention, an alignment means is provided for positioning the curler and a butting means is provided for butting the upper and lower jaws together to curl the eyelashes. The cutting means includes a sleeve coupled to the upper jaw and a plunger slideably mounted in the sleeve and coupled to the lower jaw. First and second finger grips mounted on opposit sides of the sleeve and a thumb grip at the bottom of the plunger allow the curler to be held and operated by one hand. The plunger slides along a grip axis inside the sleeve. The upper jaw is curved to match the arch of the open upper eyelid and has a jaw axis. Together the jaw axis and grip axis define the vertical plane of the eyelash curler. The alignment means includes having the finger and thumb grips positioned in the vertical plane.

In a preferred embodiment, a neck couples the upper jaw to the sleeve. The alignment means includes a sighting aperture through the neck along the vertical plane and the angle of the upper jaw. The lower edge of the upper jaw defines an upper jaw plane. The upper jaw plane intersects the grip axis at an angle less than 50°.

In operation, the curler allows a method to be practiced to accurately and efficiently curl eyelashes. The curler and eyelashes are sighted in a mirror and the curler is moved toward the eyelashes with the upper jaw on top of the eyelashes and the lower jaw below the eyelashes until the first finger grip touches the upper cheek and the thumb grip touches the lower cheek. The curler is then maneuvered while maintaining the first finger grip in contact with the upper cheek until the upper jaw contacts the eyelid at the base of the eyelashes. The curler is then in position to allow the upper and lower jaws to be butted together to curl the eyelashes.

In a preferred method, the step of sighting includes looking through the sighting aperture and the step of moving includes maintaining the reflection of the pupil of the eye from the mirror in the sighting aperture during the positioning. The preferred method may also include heating the upper head such as with warm air prior to using the curler in order to help make the lashes more pliable during the curling process and help set the desired curl.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 4:
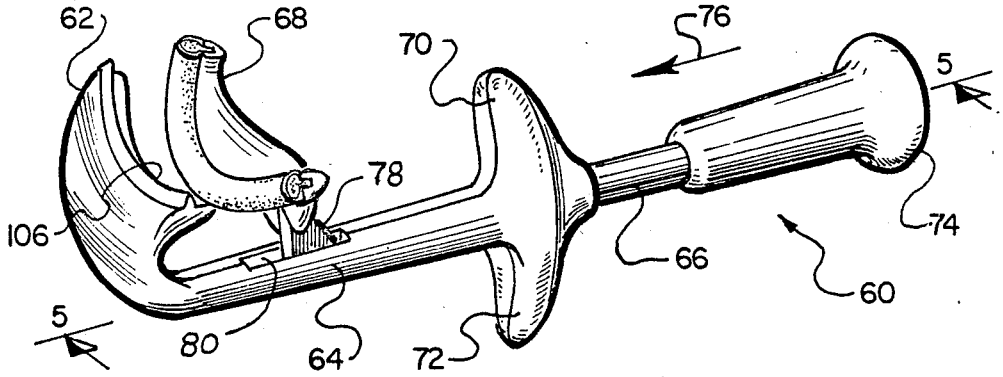
FIG. 4 is a perspective view of an eyelash curler of the present invention.

Referring initially to FIG. 4, there is illustrated a perspective view of an eyelash curler, generally designated 60, in accordance with the present invention. The eyelash curler 60 has an upper jaw 62 coupled to a sleeve 64. Sliding inside the sleeve 64 is a plunger 66 carrying a rigid lower jaw 68. First and second finger grips 70 and 72 are mounted perpendicular to and on opposite sides of the sleeve 64. A thumb grip 74 is mounted on the end of the plunger 66. The eyelash curler 60 is operated by placing the index finger on the first finger grip 70, the middle finger on the second grip 72, and the thumb on the thumb grip 74. A three finger grip means of the eyelash curler 60 is thereby provided that utilizes the optimal dexterity of the hand and is comfortable and stable. The essential holding grip is achieved by the opposed relationship between the thumb and the two fingers, i.e. the index and middle fingers press on the finger grips 70 and 72 with the force exerted in straight lines toward the thumb on the thumb grip 74. The finger grips 70 and 72 comfortably accomodate any size of fingers and can be held anywhere along the lengths of the fingers to accommodate the size, strength, and positioning needs of the individual. A maximum grip of the eyelash curler 60 is thereby assured with a minimum of effort. Optimal positioning of the curler 60 both initially at the eyelid-eyelash juncture and during the entire curling process is also assured by the three finger grip. The index finger, middle finger, and the thumb have the most dexterity of the fingers on the hand. The tips of these fingers also have greater positioning ability than other portions. When the plunger 66 is moved in the direction of the arrow 76 to close the lower jaw 68 on the upper jaw 62, the thumb moves toward the two other fingers thus maintaining the same optimal three finger grip throughout the eyelash curling process.

Figure 1:
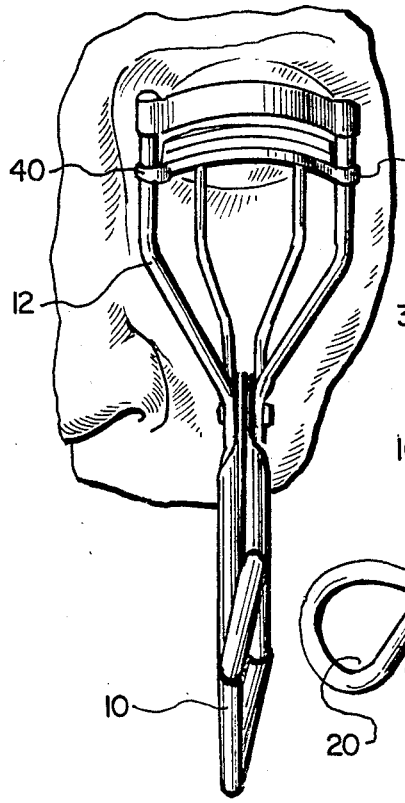
Fig.1. (PRIOR ART)
FIG. 1 is a front elevational view of a prior art eyelash curler.
Figure 2:
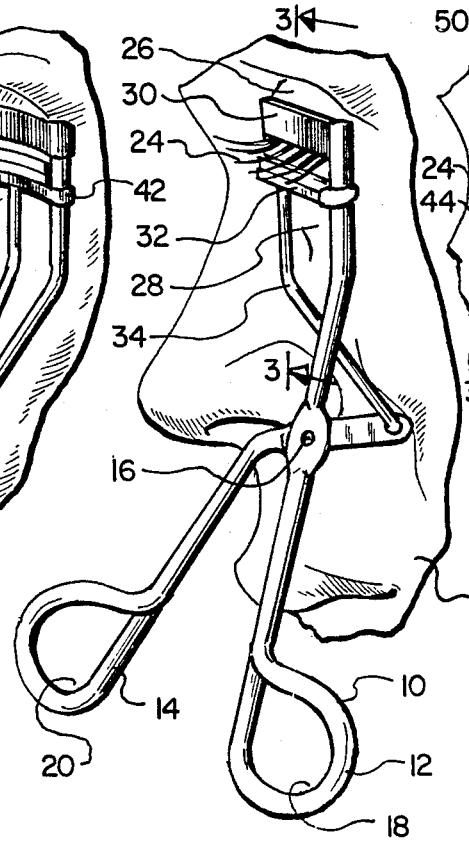
Fig.2. (PRIOR ART)
FIG. 2 is a side elevational view of the prior art curler of FIG. 1.
Figure 3:
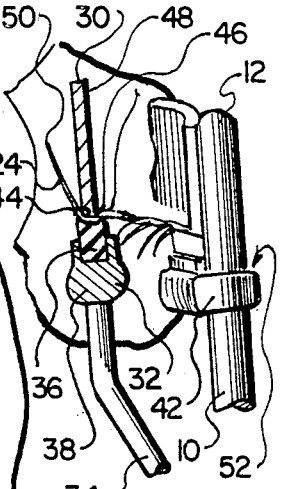
Fig.3. (PRIOR ART)
FIG. 3 is an enlarged sectional view along the line 3—3 of FIG. 2 with a break away of the related upper portion of the curler.

In comparison, the grips of the thumb and index finger on the enclosed finger grips 18 and 20 of the prior art eyelash curler 10 illustrated in FIG. 2 are usually unstable. A rigid grip of the curler 10 is only possible when the jaws 30 and 32 are closed on each other. Even then, the curler 10 may be easily rotated sideways on the thumb and finger by pushing the jaws 30 and 32 sideways. Any three point stability such as is inherent in the present invention is only achieved by the prior art eyelash curler 10 when the jaws 30 and 32 are firmly clamped on the eyelashes 24 and the eyelashes 24 themselves provide the third point. Even with this limited three point contact, the curler 10 remains unsteady and uncomfortable because of the small finger grips 18 and 20 and the positions of the grips on the ends of the thumb and finger.

The eyelash curler 60 is operated by placing the curler 60 in front of an eye with the eyelashes between the upper and lower jaws 62 and 68. The thumb is then used to push the plunger 66 into the sleeve 64 as indicated by the arrow 76. The lower jaw 68 is attached to the plunger 66 by an arm 78 that protrudes through the side of the sleeve 64 at a slot 80.

Figure 5:
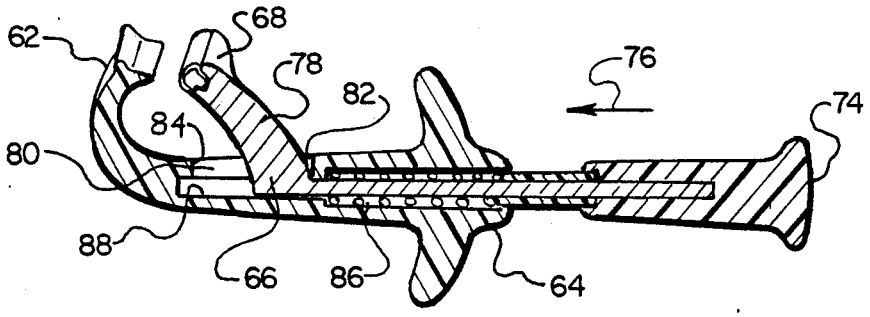
FIG. 5 is a reduced sectional view along the line 5—5 of FIG. 4.

FIG. 5 is a reduced sectional view along the line 5—5 of FIG. 4. The limits of movement of the arm 78 and the lower jaw 62 are therefore determined by the slot 80. For example, the jaws 62 and 68 are fully open when the arm 78 abuts the lower end 82 of the slot 80. The jaws 62 and 68 are fully closed as the arm 78 approaches the upper end 84 of the slot 80. Side movement of the arm 78 and the lower jaw 68 is limited by the sides of the slot 80. Minimal play is allowed between the sides of the arm 78 and the sides of the slot 80 in order assure alignment of the lower jaw 68 on the upper jaw 62 when the jaws are closed. Curling of the eyelashes occurs when the jaws 62 and 68 close on the eyelashes. The arm 78 is normally held against the lower end 82 of the slot 80 by a biasing means in the form of a coiled compression spring 86. Pressure by the thumb on the thumb grip 74 in the direction of the arrow 76 compresses the spring 86 as the plunger 66 moves along the bore 88 of the sleeve 64.

Figure 6:
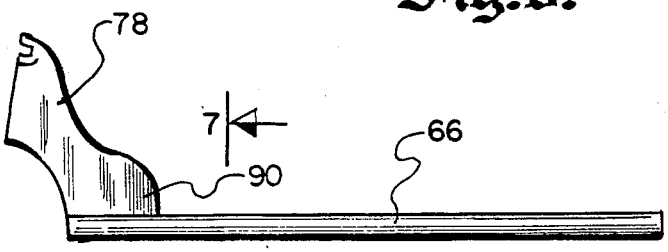
FIG. 6 is a side elevational view of the plunger.

FIG. 6 is a side elevational view of the plunger 66. A large bearing surface 90 on the arm 78 rides on the sides of the slot 80 (FIGS. 4 and 5) to maintain the alignment between the upper and lower jaws 62 and 68.

Figure 7:
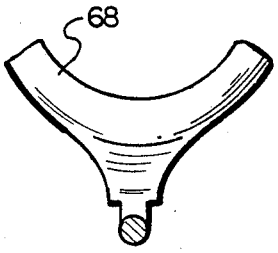
FIG. 7 is a sectional view along the line 7—7 of FIG. 6.

FIG. 7 is a sectional view along the line 7—7 of FIG. 6. The curvature of the lower head 68 matches the curvature of eyelashes on an eyelid.

Figure 8:
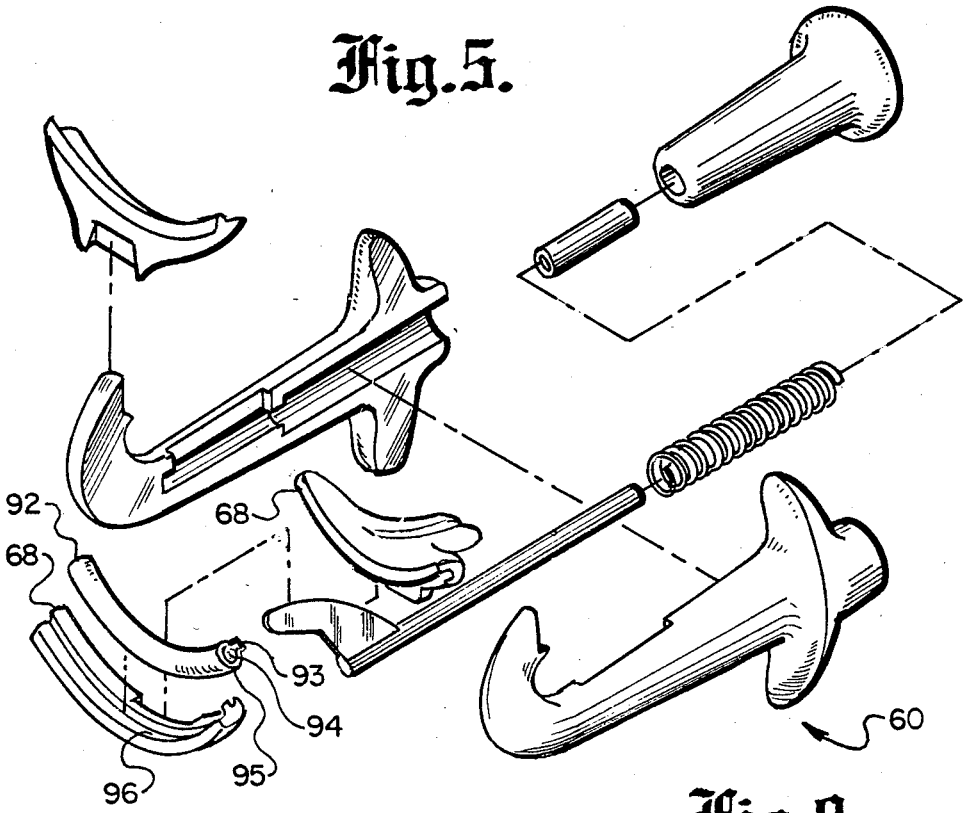
FIG. 8 is an exploded perspective view.

FIG. 8 is an exploded perspective view of the eyelash curler 60. A resilient pad member 92 is positioned on the lower jaw 68. The resilient pad member 92 is a cylinder with a tongue 93 along the bottom that is secured in a groove 96 in the top of the lower jaw 68. The resilient pad member 92 presents a convex surface 98 toward the upper jaw 62. The resilient pad member 92 is preferrably fabricated with a soft foam center 94 and a smooth outer surface or skin 95. For example, the center 94 may be soft urethane foam and the skin 95 may be latex or the center may be a silicone foam and the skin dense silicone. The skin 95 provides a cleanable surface means that protects the porous foam center 94 from mascara, body oils, tears, eyeliner and other cosmetic products found around the eyes. The skin 95 is easily cleaned of these materials whereas the foam of the center 94 would tend to retain them without the presence of the protective skin 95.

Figure 9:
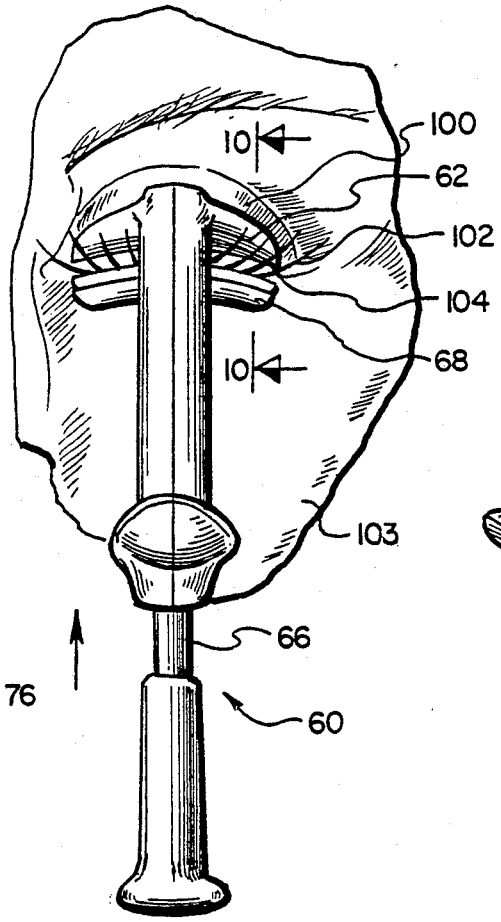
FIG. 9 is a front elevational view.

FIG. 9 is a front elevational view of the eyelash curler 60 positioned in front of an eyelid 100 ready to curl the eyelashes 102 passing between the upper and lower jaws 62 and 68. Movement of the plunger 66 to close the jaws 62 and 68 is in a single direction perpendicular to the eyelashes 102 indicated by the arrow 76. Any unnecessary movement during the operation of the plunger 66 is, therefore, also perpendicular to the eyelashes 102 and parallel to the plane of the face 103. The most that can happen due to any unnecessary movement during the initial positioning is the start of the curl of the eyelashes 102 at a position further away from the eyelid 100 than is optimally desirable. Unlike crimping which puts sharp bends in the eyelash shafts, curling creates curves extending over a greater length of the shafts. If the curl is initially started at a position further away from the eyelid 100 than is desirable, the curler 60 is simply repositioned closer to the eyelid 100 and utilized again to start the curve closer to the eyelid. If the jaws 62 and 68 are already in the process of curling the eyelashes 102 when the movement occurs, the most that can happen is the movement of the eyelashes 102 with the eyelid 100 slightly up or down. Since the eyelid 100 readily moves up or down, little additional stress is placed on the eyelashes 102 that might result in the pulling out of any eyelashes or any other damage to the eyelashes.

In comparison, the scissors action of the prior art eyelash curler 10 in FIG. 2 is in or out from the eyelid 26 and the plane of the face 22 with the result that excessive movement may lead to either the pinching of the eyelid 26 between the jaws 30 and 32, if the movement is toward the eyelid 26, or the pulling out of one or more of the eyelashes 24 from the eyelid 26, if the movement is away from the eyelid 26.

Figure 10:
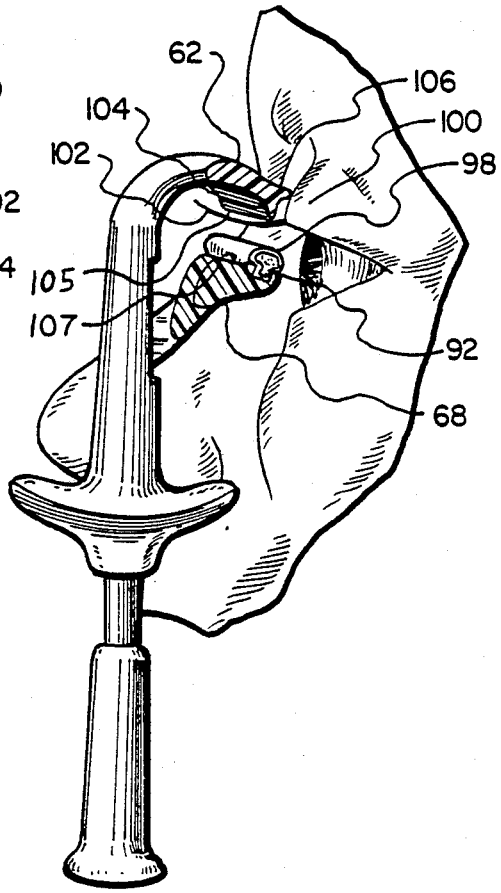
FIG. 10 is a sectional view along the line 10—10 of FIG. 9.
Figure 11:
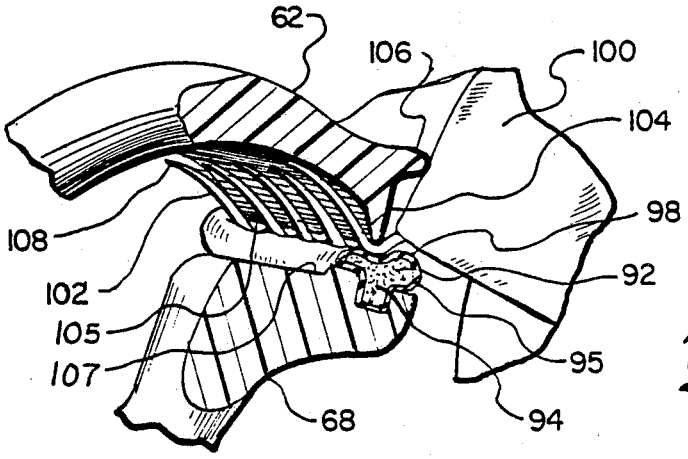
FIG. 11 is an enlarged sectional view of the jaws together.

FIG. 10 is a partial sectional view along the line 10—10 of FIG. 9. FIG. 11 is an enlarged sectional view similar to the portion of FIG. 10 in the jaw area with the upper and lower jaws 62 and 68 pressed together. The upper jaw 62 has a curling bar member 104 and a lid guard 106. The curling bar member 104 is positioned along the entire length of the upper jaw 62 (FIG. 9). The curling bar member 104 has a slightly rounded lower edge 105 providing a form around which the eyelashes 102 are bent. The upper surface 107 of the lower jaw 68 is parallel to the curling bar member 104. The lid guard 106 is a ridge running the length of the upper edge of the curling bar member 104 facing the eyelid 100 (FIG. 4). The ridge of the lid guard 106 parallels the edge of the curling bar member 104 along the entire length of the contoured face of the curling bar member 104. The lid guard 106 provides a means for spacing the upper jaw 62 from the eyelid 100 at an optimal location along the eyelashes 102 to achieve maximum lift of the eyelashes 102 when the eyelashes are curled. This optimal location for the curl is as close as possible to the eyelid 100. When the eyelashes 102 are curled at this position, the lift on the ends 108 of the eyelashes is as high as possible for a given curl angle. As shown in FIG. 10, the initial positioning of the upper jaw 62 on the eyelashes 102 is achieved by slipping the eyelashes 102 between the upper and lower jaws 62 and 68 until the lid guard 106 touches the eyelid 100 as shown in FIG. 10. The jaws 62 and 68 can then be closed curling the eyelashes 102 without pinching the eyelid 100. If the upper jaw 68 should happen to be moved inadvertently further towartd the eyelid 100, the lid guard 106 physically keeps the eyelid 100 out of the space between the jaws 62 and 68. The increased pressure of the lid guard 106 on the eyelid 100 is immediately sensed by the user allowing corrective positioning to be made. If the upper jaw 62 is positioned too far away from the eyelid 100, the lid guard 106 does not make the proper contact and the lack of pressure on the eyelid 100 indicates to the user that the upper jaw 62 is not properly positioned and should be moved closer to the eyelid 100. If the eyelash curler 60 is being used by someone to curl the eyelashes of another, the lid guard 100 serves both as a physical bumper against the eyelid 100 and a visual indicator of the proper positioning of the upper jaw 62.

FIG. 10 illustrates the pad member 92 in an uncompressed situation with a normally convex upper surface 98. When the curler 60 is used, the convex upper surface 98 dents around the form of the lower edge 105 of the bar member 104 as shown in FIG. 11 as the lower edge is pressed into the pad member 92. Both the softness of the pad member 92 and the convex shape of the upper surface 98 of the pad member 92 contribute to the curling process. As noted above in conjunction with FIG. 9, the pad member 92 is fabricated with a soft porous foam center 94 protected by a skin 95. The center 94 allows the pad member 92 to press the eyelashes 102 into the curved form of the lower edge 105 of the bar member 104 without causing any damage to the eyelash shafts as occurs with harder pads. The convex upper surface 98 provides further advantageous characteristics not available with flat pads of previous eyelash curlers. The pressure required to form the pad member 92 around the shape of the edge bar member 104 is less than the pressure required to achieve the same set with a flat top pad of the same material because less lateral pad material is present in the pad member 92.

Figure 12:
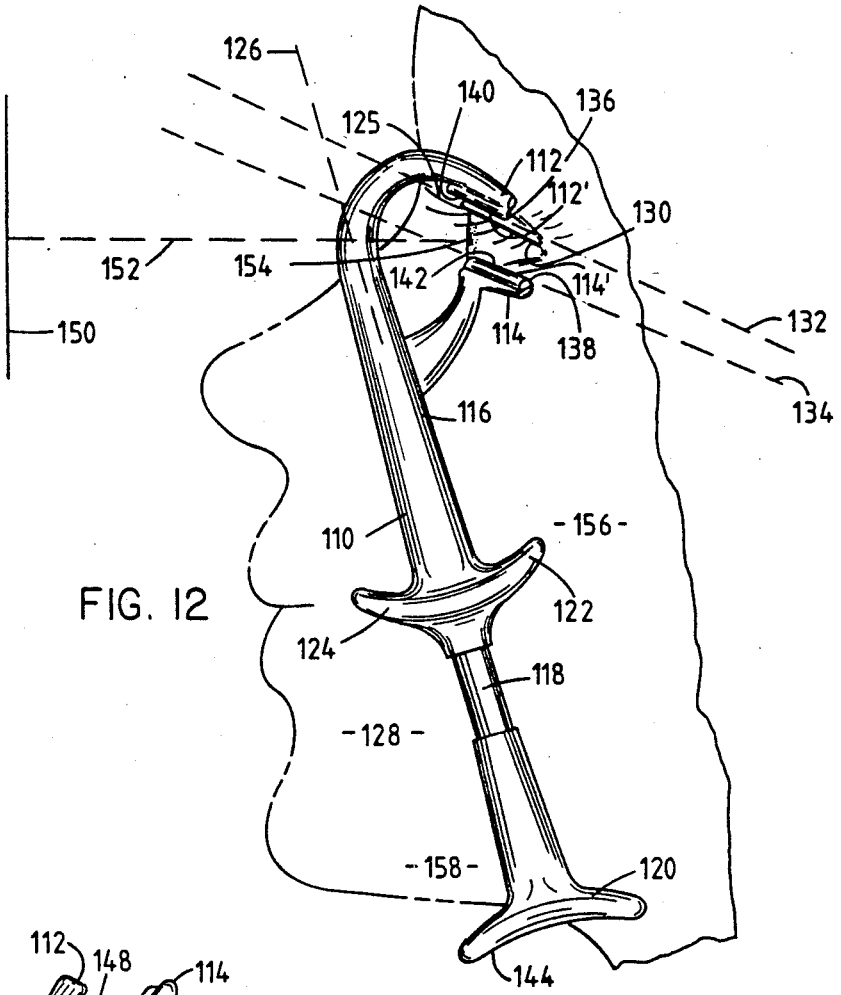
FIG. 12 is a side elevational view of another embodiment.

FIG. 12 is a side elevational view of another embodiment, generally designated 110, of the present invention. A comparison of the present curler 110 with the curler 60 in FIG. 10 reveals several refinements including the increasing of the angle of the head structure to the handle, i.e., the angles of the upper jaw 112 and lower jaw 114 to the sleeve 116 and the plunger 118, the overall elongation of the curler 110, and the elongation of the thumb grip 120 matching the length of the first and second finger grips 122 and 124. These changes enhance the ability of the user to initially align the curler 110 on the eyelashes 125 and to maintain the curler in proper alignment during the curling operation.

The grips 120, 122, and 124 provide a means for butting the lower jaw 114 against the upper jaw 112 when the thumb grip 124 is pressed upward. The plunger 118 is coupled to the thumb grip 124 and the lower jaw 114 and is slideably mounted inside the sleeve 116. The plunger 118 moves along the grip axis denoted by the dotted line 126. The thumb grip 124 is substantially perpendicular to the grip axis 126. The first and second finger grips 122 and 124 are located on opposite sides of the grip axis 126 and are coupled to the sleeve 116. The upper jaw 114 is positioned on the other end of the sleeve 116. The resulting three point grip means provides optimal stability for initially positioning and holding the curler 110 during the curling operation where the only movement is the linear movement of the plunger along the grip axis 126. This movement along the grip axis 126 is essentially parallel to the face 128.

The upper jaw 112 has a lower edge 112' that is curved to substantially match the curvature or arch of the open upper eyelid 130. The curve of the lower edge 112' lies in a plane perpendicular to page showing FIG. 12. The center of the curve of the upper jaw 112 and the upper jaw plane define the upper jaw axis represented by the line 132. This upper jaw axis intersects the grip axis 126 at an angle of approximately 48°. In comparison, the upper jaw axis of the curler 60 in FIG. 10 intersects the grip axis at an angle of approximately 75°. The upper head to handle intersection angles of the devices in the prior art patents discussed above are approximately: U.S. Pat. Nos. 1,951,130=68°; 2,129,755=71°; 2,252,742=86°; 2,391,047=76°; 2,393,848=90°; 2,411,519=76°; 2,552,095=90°; 2,584,668=75°; and 2,684,679=77°; and French Pat. Nos. 907,936=67° and 945,545=82°. The significant decrease in the angle between the upper jaw and the grips in the embodiment of the curler 110 illustrated in FIG. 12 positions the thumb and finger grips 120, 122, and 124 adjacent the face 128 allowing the face to be used as a continuous tactile reference during both the positioning and curling process. All of the prior art devices place the handles away from the face.

The lower edge 112' of the upper jaw 112 faces the lower jaw 114. The lower jaw 114 has an upper edge 114' curved to match the upper jaw 112 which defines a lower jaw plane that is also perpendicular to the page illustrating FIG. 12. The center of the curve of the lower jaw 114 and the lowerjaw plane define the lower jaw axis represented by the line 134. This lower jaw axis intersects the grip axis 126 at an angle of approximately 52°. The difference of approximately 4° between the angles of intersection of the upper and lower jaw axes 132 and 134 and the grip axis 126 causes the outer tips 136 and 138 of the upper and lower jaws 112 and 114 to touch prior to the touching of the respective middles 140 and 142 when the jaws are butted against each other. Uniform pressure between all portions of the upper and lower jaws is thereby achieved to allow the uniform curling of all of the lashes.

The intersecting grip axis 126 and the upper jaw axis 132 together define a vertical plane through the center of the curler 110 that is parallel to the plane of the page illustrating FIG. 12. The lower jaw axis 134, the thumb grip 120, and the first and second finger grips 122 and 124 are all substantially aligned with this vertical plane. This uniform alignment in turn provides a means for aligning the curler 110 with respect to the eyelashes 125, the face 128, and the eyelid 130.

In addition, the alignment means includes providing the thumb grip 120 with a length approximately two and a half times its width with the length being in the same vertical plane as the upper jaw axis 132. A concave lower surface 144 on the thumb grip 120 aids in the tactile identification of the center and longitudinal ends of the grip and permits the comfortable use of the grip by any portion of the thumb including the tip, middle, or palm portion.

Figure 13:
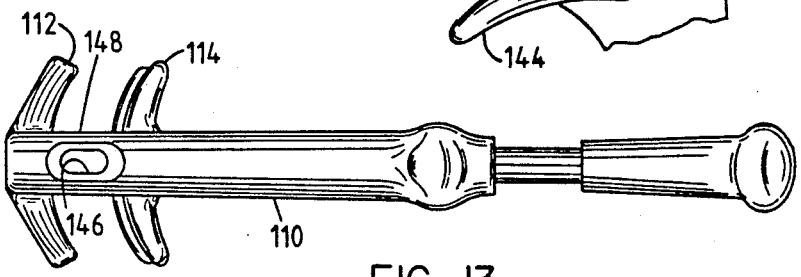
FIG. 13 is a rear elevational view of the embodiment of FIG. 12.

FIG. 13 is a rear elevational view of the curler 110 and illustrates an additional means for aligning the curler 110. A sighting aperture 146 is added in the neck 148 between the upper jaw 112 and the lowest level of the lower jaw 114. The sighting aperture 146 is in alignment with the vertical plane of the curler 110 which is perpendicular to the page illustrating FIG. 13 and is along the length of the curler.

Figure 14:
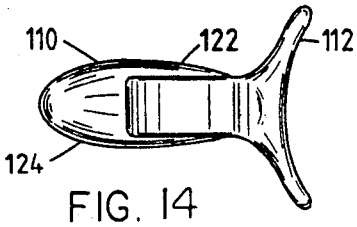
FIG. 14 is a top plan view of the embodiment of FIG. 12.
Figure 15:
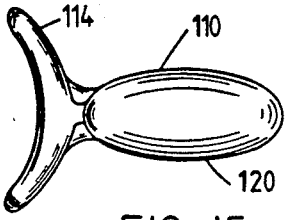
FIG. 15 is a bottom plan view of the embodiment of FIG. 12.

FIG. 14 is a top plan view of the curler 110 of FIGS. 12 and 13 showing the relative sizes and alignment of the upper jaw 112 and the first and second finger grips 122 and 124. FIG. 15 is a bottom plan view of the curler 110 showing the relative sizes and alignment of the lower head 114 and the thumb grip 120.

Use of the curler 110 to curl the eyelashes 125 is illustrated in FIG. 12. The person holds the curler with two fingers on the first and second finger grips 122 and 124 and a thumb on the thumb grip 120. The eyelash curler is sighted in a mirror 150 through the sighting aperture 146 as indicated by the sighting line 152. The curler 110 is moved toward the eyelashes 125 while maintaining the reflection of the pupil 154 of the eye from the mirror 148 in the sighting aperture until the upper jaw 112 is positioned on top of the eyelashes, the lower jaw is positioned below the eyelashes, the first finger grip 122 touches the upper cheek 156, and the thumb grip touches the lower cheek 158. Once tactile contact with the cheek is made, the hand is maneuvered slightly about the first finger grip 122 with the first finger grip remaining in contact with the upper cheek 156 until the upper jaw 112 contacts the eyelid 130. The thumb grip 120 may leave contact with the lower cheek 158 when the curler 110 is maneuvered into the proper position. Once in the proper position, the thumb grip 120 is squeezed toward the finger grips 122 and 124 until the lower jaw 114 butts against the upper jaw 112 curling the eyelashes 125 between them.

If desired, the upper jaw 112 may be heated prior to commencement of the curling process such as by the use of warm air. For example, a hair dryer will quickly heat up the jaw 112. Then when the eyelashes 125 are squeezed between the upper and lower jaws 112 and 114, some of the heat is transferred to the eyelashes making them more pliable thereby helping to set the desired curl. A working temperature in the range of 120°-130° F. provides good results.

In view of the above, it may be seen that eyelash curlers and methods of use are provided that significantly improves the eyelash curling procedure with greater safety and less difficulty. Of course, the structure and method may be variously implemented and variously used depending upon specific applications. Accordingly, the scope hereof shall not be referenced to the disclosed embodiment, but on the contrary, shall be determined in accordance with the claims as set forth below.

I claim:

1. A curler for eyelashes, comprising:

an upper jaw for placement on top of said eyelashes;

a lower jaw for placement under said eyelashes;

a means for aligning said upper jaw on top of said eyelashes and said lower jaw under said eyelashes;

a means for butting said upper and lower jaws together having:

a sleeve coupled to one of said upper and lower jaws;

a plunger slideably mounted in said sleeve and coupled to the other of said upper and lower jaws;

a grip axis, said plunger sliding along said grip axis inside said sleeve;

first and second finger grips mounted on opposite sides of said grip axis and coupled to one of said sleeve and said plunger; and a thumb grip coupled to the other of said sleeve and said plunger spaced from said upper and lower jaws;

said upper and lower jaws curling said eyelashes when butted together;

said upper jaw is curved to substantially match the arch of an open eyelid having said eyelashes and has a jaw axis;

said jaw axis and said grip axis intersect defining a vertical plane; and a neck coupling one of said sleeve and said plunger to said upper jaw at said vertical plane.

2. The eyelash curler according to claim 1 wherein:

said upper jaw is curved to substantially match the arch of an open eyelid having said eyelashes and has a jaw axis;

said thumb grip is mounted substantially perpendicular to said grip axis; and said alignment means includes said thumb grip having a length at least twice as great as its width with said length substantially in alignment with said jaw axis.

3. The eyelash curler according to claim 2 wherein said thumb grip further includes a concave lower surface.

4. The eyelash curler according to claim 1 wherein said alignment means includes a sighting aperture through said neck along said vertical plane.

5. A curler for eyelashes, comprising:

an upper jaw for placement on top of said eyelashes;

a lower jaw for placement under said eyelashes;

a means for aligning said upper jaw on top of said eyelashes and said lower jaw under said eyelashes;

a means for butting said upper and lower jaws together having:

a sleeve coupled to one of said upper and lower jaws;

a plunger slideably mounted in said sleeve and coupled to the other of said upper and lower jaws;

a grip axis, said plunger sliding along said grip axis inside said sleeve;

first and second finger grips mounted on opposite sides of said grip axis and coupled to one of said sleeve and said plunger; and a thumb grip coupled to the other of said sleeve and said plunger spaced from said upper and lower jaws;

said upper and lower jaws curling said eyelashes when butted together;

said upper jaw is curved to substantially match the arch of an open eyelid having said eyelashes and has a jaw axis and a lower edge facing said lower jaw, said lower edge defining an upper jaw plane; and said alignment means includes said upper jaw plane intersecting said grip axis at an angle less than 60°.

6. The eyelash curler according to claim 5 wherein said upper jaw plane intersects said grip axis at an angle less than 50°.

7. The eyelash curler according to claim 5 wherein said lower jaw is curved to substantially match said curvature of said upper jaw and has an upper edge defining a lower jaw plane and said lower jaw plane intersects said grip axis at an angle at least 2° greater than the angle of intersection of said upper jaw plane with said grip axis.

8. The eyelash curler according to claim 7 wherein said lower jaw plane intersects said grip axis at an angle at least 10° greater than the angle of intersection of said upper jaw plane with said grip axis.

9. The eyelash curler according to claim 5 wherein:

said jaw axis and said grip axis intersect defining a vertical plane; and further including:

a neck coupling one of said sleeve and said plunger to said upper head at said vertical plane; wherein:

said aligning means further includes:

a sighting aperture through said neck along said vertical plane; and said first and second finger grips in said vertical plane.

10. A method for curling eyelashes, comprising the steps of:

providing an eyelash curler having:

an upper jaw curved to substantially match the arch of an open eyelid having said eyelashes and having a jaw axis;

a lower jaw;

a means for butting said upper and lower jaws together having a grip axis;

said jaw and grip axis defining a vertical plane; and an alignment means including first and second finger grips and a thumb grip in said vertical plane;

holding said eyelash curler with two fingers on said first and second finger grips and a thumb on said thumb grip;

sighting said eyelashes through said eyelash curler in said mirror;

moving said eyelash curler toward said eyelashes with said upper jaw on top of said eyelashes and said lower jaw below said eyelashes until said first finger grip touches the upper cheek and the thumb grip touches the lower cheek;

maneuvering said eyelash curler on said first finger grip with said first finger grip remaining in contact with said upper cheek until said upper jaw contacts said eyelid; and butting said upper and lower jaws together.

11. The method for curling eyelashes as recited in claim 10 wherein:

said step of providing an eyelash curler further includes said eyelash curler having a neck coupling said upper jaw to said butting means at said vertical plane and said alignment means includes a sighting aperture through said neck along said vertical plane;

said step of sighting said eyelashes includes sighting through said sighting aperture; and said step of moving includes maintaining the reflection of the pupil of the eye from said mirror in said sighting aperture.

12. The method for curling eyelashes as recited in claim 11 and further comprising the step of heating at least one of said upper and lower jaws.

* * * * *